US007988016B2

(12) United States Patent
Klein et al.

(10) Patent No.: US 7,988,016 B2
(45) Date of Patent: Aug. 2, 2011

(54) MEDICINE CONTAINER WITH SINGLE PILL DISPENSER

(76) Inventors: Seth A. Klein, Boca Raton, FL (US); Michael R. Klein, Boca Raton, FL (US)

( * ) Notice: Subject to any disclaimer, the term of this patent is extended or adjusted under 35 U.S.C. 154(b) by 0 days.

(21) Appl. No.: 12/367,236

(22) Filed: Feb. 6, 2009

(65) Prior Publication Data

US 2009/0194556 A1 Aug. 6, 2009

Related U.S. Application Data

(60) Provisional application No. 61/026,717, filed on Feb. 6, 2008.

(51) Int. Cl.
*B65H 3/00* (2006.01)
*B65D 83/00* (2006.01)

(52) U.S. Cl. ..... 221/263; 221/246; 221/1; 221/266; 221/164; 221/152; 221/65; 221/64; 221/160

(58) Field of Classification Search ..... 221/246, 221/1, 266, 154, 263, 152, 65, 64, 160
See application file for complete search history.

(56) References Cited

U.S. PATENT DOCUMENTS 2,673,777 A * 3/1954 Ward ..... 221/200
2,683,554 A * 7/1954 Mulhauser, Jr. ..... 221/152
2,962,190 A * 11/1960 Horland ..... 221/202
3,586,208 A * 6/1971 Hussey ..... 221/299
3,991,908 A * 11/1976 Thomas et al. ..... 221/154
4,230,236 A * 10/1980 Boulter ..... 221/190
4,460,106 A * 7/1984 Moulding et al. ..... 221/1
4,744,492 A * 5/1988 Hackmann et al. ..... 221/204
5,018,644 A * 5/1991 Hackmann et al. ..... 221/65
5,971,154 A * 10/1999 Toren ..... 206/534
7,073,685 B1 * 7/2006 Giraud et al. ..... 221/64
2004/0124204 A1 * 7/2004 Giraud ..... 221/263
2011/0060457 A1 * 3/2011 De Vrught et al. ..... 700/241

* cited by examiner

*Primary Examiner* — Gene O. Crawford
*Assistant Examiner* — Rakesh Kumar

(57) ABSTRACT

A pill dispensing cap that secures to a conventional pill container. The pill dispensing cap has a lower cap, a pill discharge port, and a spring loaded rotatable and slidable upper cap. Pills are dispensed one at a time, and the remaining pills are isolated from external contamination. A child resistant lock prevents small children and/or mentally handicapped individuals from easily accessing medicine inside the container. The child resistant lock uses a vertically slidable upper cap that is slidably and rotatably attached to the lower cap. A child safety lock uses a key in the upper cap that must be aligned with a slot in the lower cap to allow a pill to be dispensed. When the key and slot are aligned, the upper cap is vertically compressed against the lower cap. As the upper cap moves toward the base cap, a gravity fed pill discharge port is exposed which releases a single pill.

6 Claims, 11 Drawing Sheets

MEDICINE CONTAINER WITH SINGLE PILL DISPENSER

CROSS-REFERENCE TO RELATED APPLICATIONS

This application is related to, and claims the benefit of the now expired provisional patent application entitled "Medicine Container With Single Pill Dispenser", filed Aug. 23, 2005, bearing U.S. Ser. No. 60/596,014 and naming Seth A. Klein and Michael R. Klein, the named inventors herein, as sole inventors, and the co-pending non-provisional application entitled "Medicine Container With Single Pill Dispenser", filed Aug. 23, 2006, bearing U.S. Ser. No. 60/596,014 and naming Seth A. Klein and Michael R. Klein, the named inventors herein, as sole inventors the contents of both are specifically incorporated by reference herein in their entirety.

BACKGROUND OF THE INVENTION

1. Technical Field

The present invention relates to medicine containers. In particular, it relates to a medicine container with a cap that has an integral dispensing mechanism that releases a single pill at a time and protects against unnecessary contamination of the unused pills.

2. Background of the Invention

As the pharmaceutical industry enters the 21$^{st}$ century, it faces a number of challenges. Effective and innovative packaging can help the industry meet some of those challenges. In the past, packaging was often in afterthought for many companies. More recently, drug makers and pharmacies are using packaging and labeling as tools to promote their products, as packaging has been found to be an effective marketing and branding tool to promote customer loyalty, provide product differentiation, meet government regulations, an increase the convenience of use of the products so as to increase patient compliance with medication protocols.

Pharmaceutical packaging design is increasingly becoming more complex. An aging population has created the need for senior-friendly packaging. Further, growing competition in the pharmaceutical industry has increase the importance of packaging as a product positioning tool. One aspect of packaging is its visual component. Attractive packaging is always important for any product. However, another and perhaps more important aspect of packaging of medications is its functional characteristics. In particular, errors when taking medication are common for all individuals, but some groups of individuals, such as the elderly, may be more prone to making mistakes and others. Likewise, physical impairment related to age or other infirmities may also make it more inconvenient for some individuals to take medications. It would be desirable to have medication packaging that would be less prone to error, and more convenient to use.

Another issue related to pharmaceutical packaging is the benefit that individual manufacturers receive by differentiating their products from those of their competitors. Distinctive and unique packaging and be an effective method of product differentiation. Therefore it can be a critical component of branding, merchandising, and promotional activities. It would be desirable to have unique packaging for pharmaceutical products which would differentiate it from competitive products, not only in appearance, but also in they are functional operation.

Most products undergo a number of modifications improvements over time. By the time atypical product reaches a half-century mark, it is usually been through multiple versions and designs. However, this is not the case for the conventional amber-cast pharmacy the container. That container, with the exception of a child's-safety cap which was added in the 1970s, has remained virtually unchanged.

Other problems are associated with the standard pill containers used by pharmacies. A first issue is the one discussed above, where it can be very difficult to dispense pills by elderly or disabled patients who cannot easily remove the cap from the pill container. Second, contamination is another important issue related to dispensing medications and other pharmaceuticals. When removing a conventional cap, individuals may pour out multiple pills into their hands or other surfaces, take the required number of pills, and replace the remaining pills into the pill container. Unfortunately, this practice creates a situation where the medication or other pharmaceuticals may become contaminated by bacteria from the individual's hand or from other surfaces. This creates an undesirable situation in that bacteria, or other contaminants, may be placed on the pills themselves and later disseminated to unwary individuals. This can be especially dangerous situations where a health-care provider, such a nurse, may go from room to room dispensing medications in a hospital. If the nurse was that careful about washing their hands each time they enter a room, it is possible that infections may be spread throughout a hospital merely by mishandling medication. It would be desirable to have a method of dispensing pills which would protect unused pills from unnecessary contamination through handling by patients or other health care providers.

While the prior art has provided a variety of useful pharmaceutical containers, it has failed to provide a container capable of dispensing pills individually in an easy to use and convenient dispenser, which allows an individual to dispense a single pill with a single motion, and which simultaneously protects the unused pills from contamination.

SUMMARY OF THE INVENTION

The present invention provides an integral dispensing mechanism for a medicine container. The pill dispensing mechanism is a pill dispensing cap that secures to a conventional pill container. The pill dispensing cap has a lower cap, a pill discharge port, and a spring loaded rotatable and slidable upper cap. The pill dispensing cap has an integral child resistant lock designed to prevent small children from easily accessing medicine inside the medicine container. The child resistant lock uses a vertically slidable upper cap that is slidably and rotatably attached to the lower cap. A child safety lock uses a key in the upper cap that must be aligned with a slot in the lower cap to allow a pill to be dispensed. When the key and slot are aligned, the upper cap is vertically compressed against the lower cap. As the upper cap moves toward the base cap, a pill discharge port is exposed which releases a single pill. An individual pill is dispensed with a single compression of the cap toward the pill container, and prevents contact with the other pills by any potential outside contaminant such as a hand, or other surface.

DESCRIPTION OF THE PREFERRED EMBODIMENT

Figure 1A:
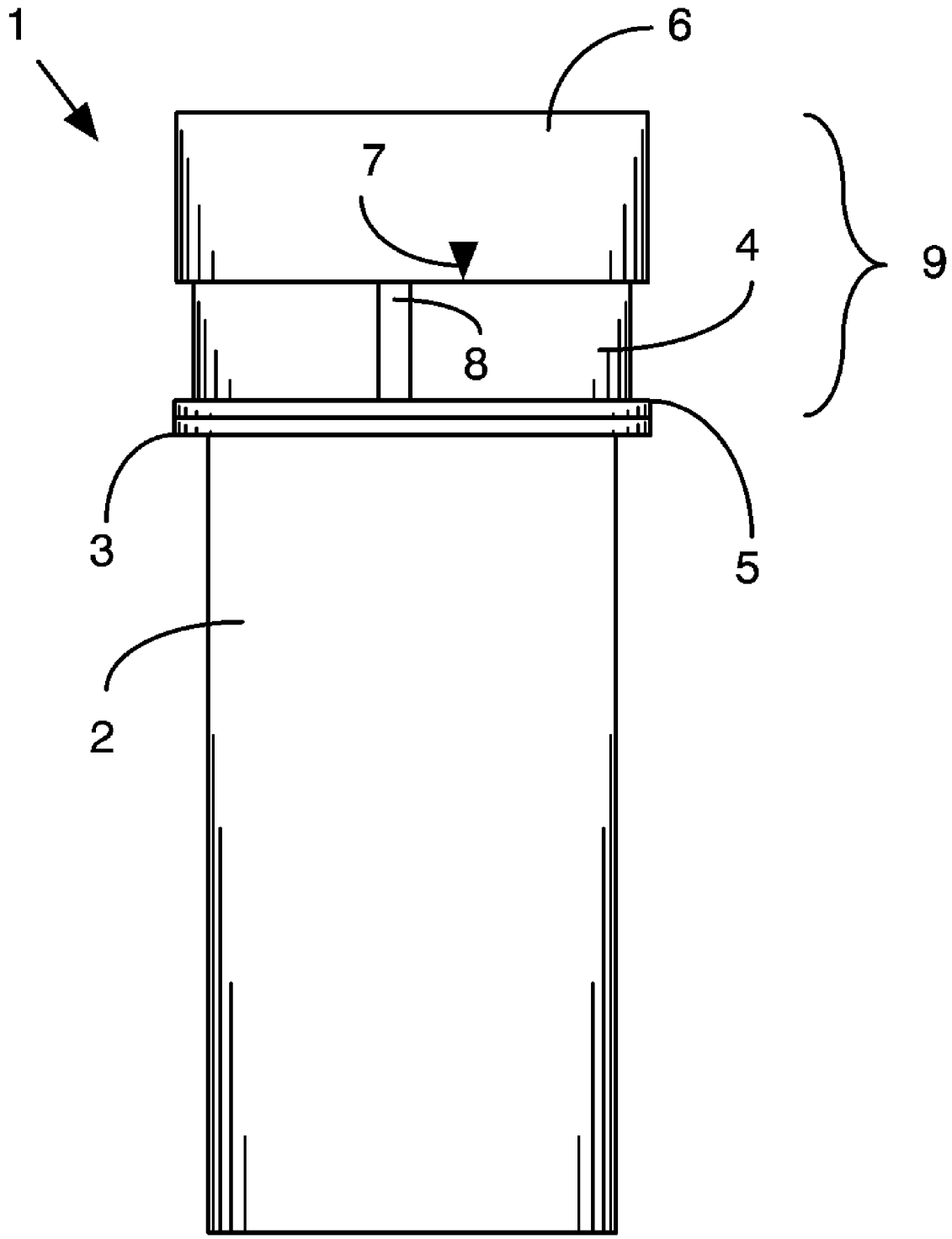
FIG. 1A illustrates an exterior view of a preferred embodiment of a medicine container with the pill dispensing cap in the locked position.

Before discussing the details of the test figures, a general overview of the invention will be presented. The invention provides a new pill dispensing cap for medication or pill containers which has several advantages over the prior art. Most important, the pharmaceuticals or neutraceuticals (i.e. vitamins, minimums, dietary supplements, etc.) contained within pill containers are protected from contamination by preventing them from coming in contact with an individual's hand, or other surface, until they are ready to be ingested. This is accomplished by the cap which only allows a single pill to exit the pill container at a time. In a situation where there is a chance that bacteria or other infectious material may be transferred to contact, avoiding such contact can be very important step in preventing the spread of disease or infections. As mentioned briefly above, in healthcare facilities such as a hospitals, nursing homes, assisted-living centers, etc., a health-care provider proceeds from one patient room to another may inadvertently contaminate the medication in each of the rooms.

In the case of pills, a health care professional typically opens the pill container and attempts to discharge a single pill. Unfortunately, this does not always work as planned. When the healthcare professional returns the excess pills to the container, they may have been contaminated by coming in contact with the healthcare professional. In situations, such as health care facilities, this can lead to dangerous situations. For example, the principal cause of the spread of MRSA in health care facilities is the failure of physicians, nurses, and other health-care providers to wash their hands each time they enter a patient's room. Of course, if they have the MRSA bacteria on their hands and inadvertently transfer in to a pill when returning excess pills to the pill container, the patient will ingest the MRSA when the pill is consumed. Those skilled in the art will recognize that MRSA is only one of thousands, perhaps millions, of potential infectious agents. By eliminating unnecessary contact with pills, the pill container cap provided by this invention will reduce the chance of spreading infections and disease.

In contrast, while the healthcare providers could contaminate the pills, there's also the reverse situation where specific medications can be harmful to individuals who handle them. For example, Propecia™ should never be handled by pregnant women. If a nurse is pregnant, harm may come to the fetus merely by distributing the pills to a patient. As a result, the cap disclosed by this invention protects not only the recipient of medication, but the health care provider who distributes it as well.

Disease prevention is not the only advantage provided by the invention. For example, other advantages are:

1. The pill container cap is designed to attach to all existing pharmaceutical and nutraceutical pill containers.

2. The pill container cap does not make a significant difference in the size of the pill container. Therefore it is compact, and ideal for storage and pockets, handbags, glove compartments, desk drawers, etc.

3. The pill container cap creates a hygienic environment with pills, and prevents them from becoming contaminated prior to use.

4. The pill container cap avoids unnecessary handling of potentially harmful pharmaceuticals.

5. The pill container cap is more convenient to use since only one hand is necessary to dispense a pill.

In general, the invention provides a medication container cap which allows individual convenience of automatically dispensing a single pill by merely pressing the cap toward the body of the medication container. In addition, it provides a method of protecting medications from contamination by preventing unnecessary handling. Having discussed the advantages of the invention in general, we turn now to a more detailed discussion of the figures.

FIG. 1A illustrates an exterior view of a preferred embodiment of a medicine container 1 with the pill dispensing cap 9 in the locked position. In this view, a convention pill storage compartment 2 is sealed by a pill dispensing cap 9. The pill dispensing cap 9 has several components. The lower cap 4 has a lower rim 5 that is secured against the upper rim 3 of the pill storage compartment 2. The slidable upper cap 6 is rotatably and slidably attached to lower cap 4.

The pill dispensing cap 9 has a locking mechanism to prevent children from inadvertently dispensing pills. This figure shows the medicine container 1 in the locked position. As will be described in greater detail below, a pill can only be dispensed when upper cap 6 is compressed against lower cap 4. When in the locked position, an internal key, whose location is indicated by key indicia 7 on the outside surface of upper cap 6, is misaligned with key slot 8. When misaligned, upper cap 6 is prevented from being compressed against lower cap 4, thereby preventing inadvertent dispensing of pills.

Figure 1B:
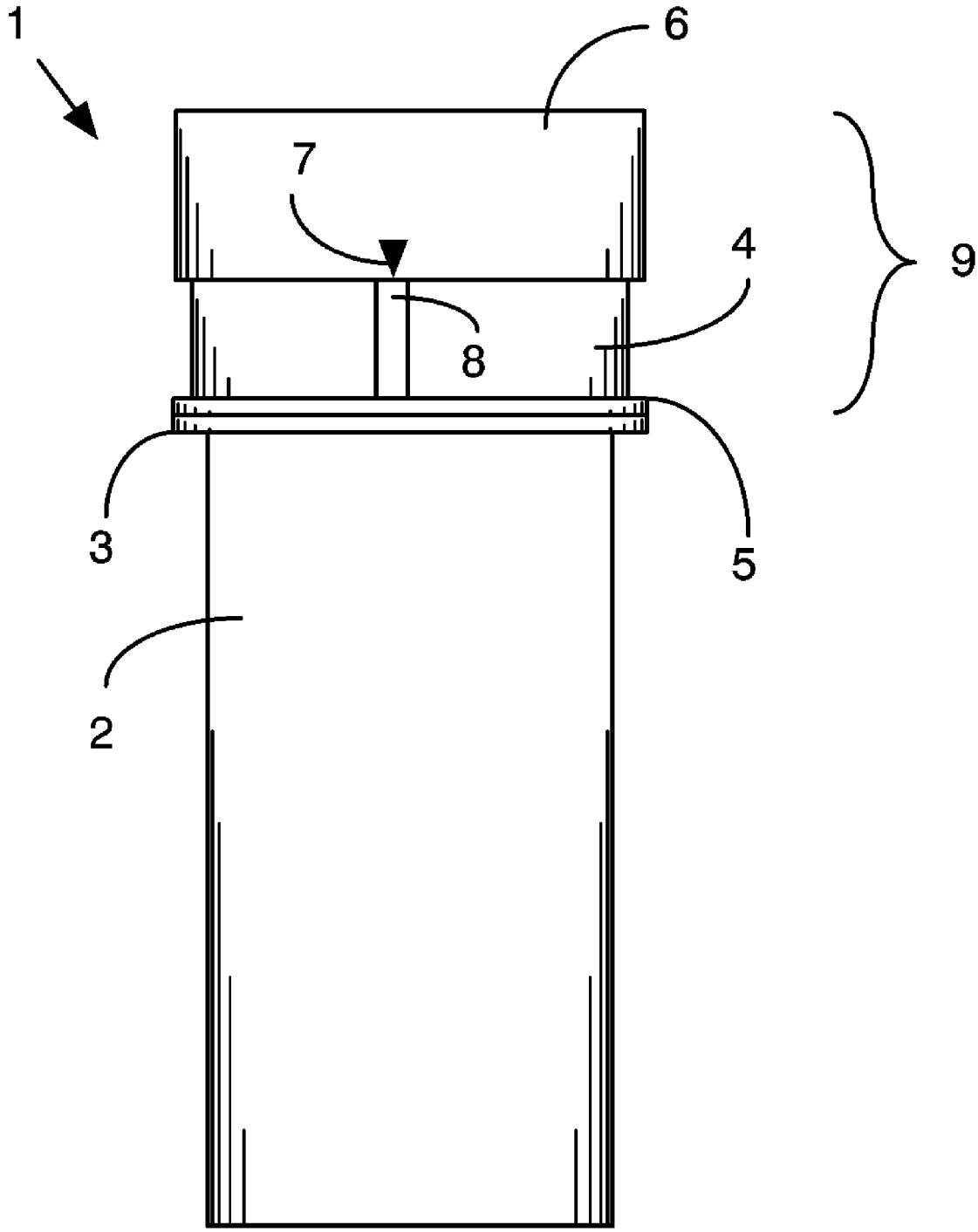
FIG. 1B illustrates an exterior view of a preferred embodiment of a medicine container with the pill dispensing cap in the unlocked position.

FIG. 1B illustrates an exterior view of the medicine container 1 with the pill dispensing cap 9 in the unlocked position. The upper cap 6 is designed to rotate in relation to lower cap 4. When the upper cap 6 is rotated such that the key indicia is aligned with key slot 8, the spring loaded upper cap 6 can be compressed toward lower cap 4 to release a pill.

Figure 1C:
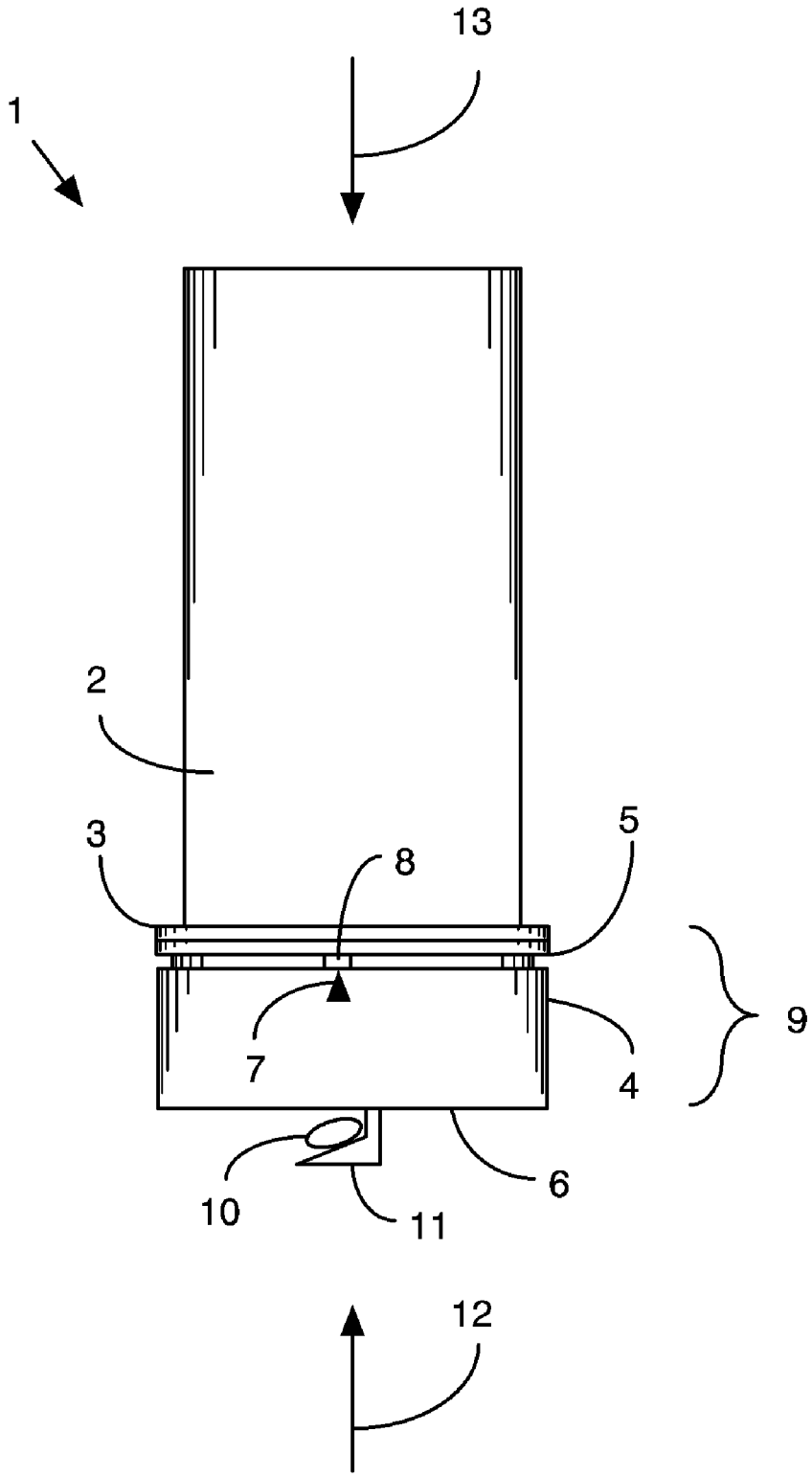
FIG. 1C illustrates an exterior view of a preferred embodiment of a medicine container with a pill being dispensed from the central pill channel.

FIG. 1C is an exterior view of the medicine container 1 illustrating a pill 10 being dispensed. To dispense a pill 10, the medicine container 1 is first unlocked. Then, the medicine container 1 is inverted to take advantage of a gravity feed that delivers a pill 10 to a pill discharge port 11. When the upper cap 6 is compressed against the lower cap 4 (as indicated by lines 12-13), pill discharge port 11 is uncovered. It has sufficient space to hold a single pill 10 between discharge port arms 20-21. When discharge port 11 is uncovered, a pill 10 is dispensed.

Figure 2A:
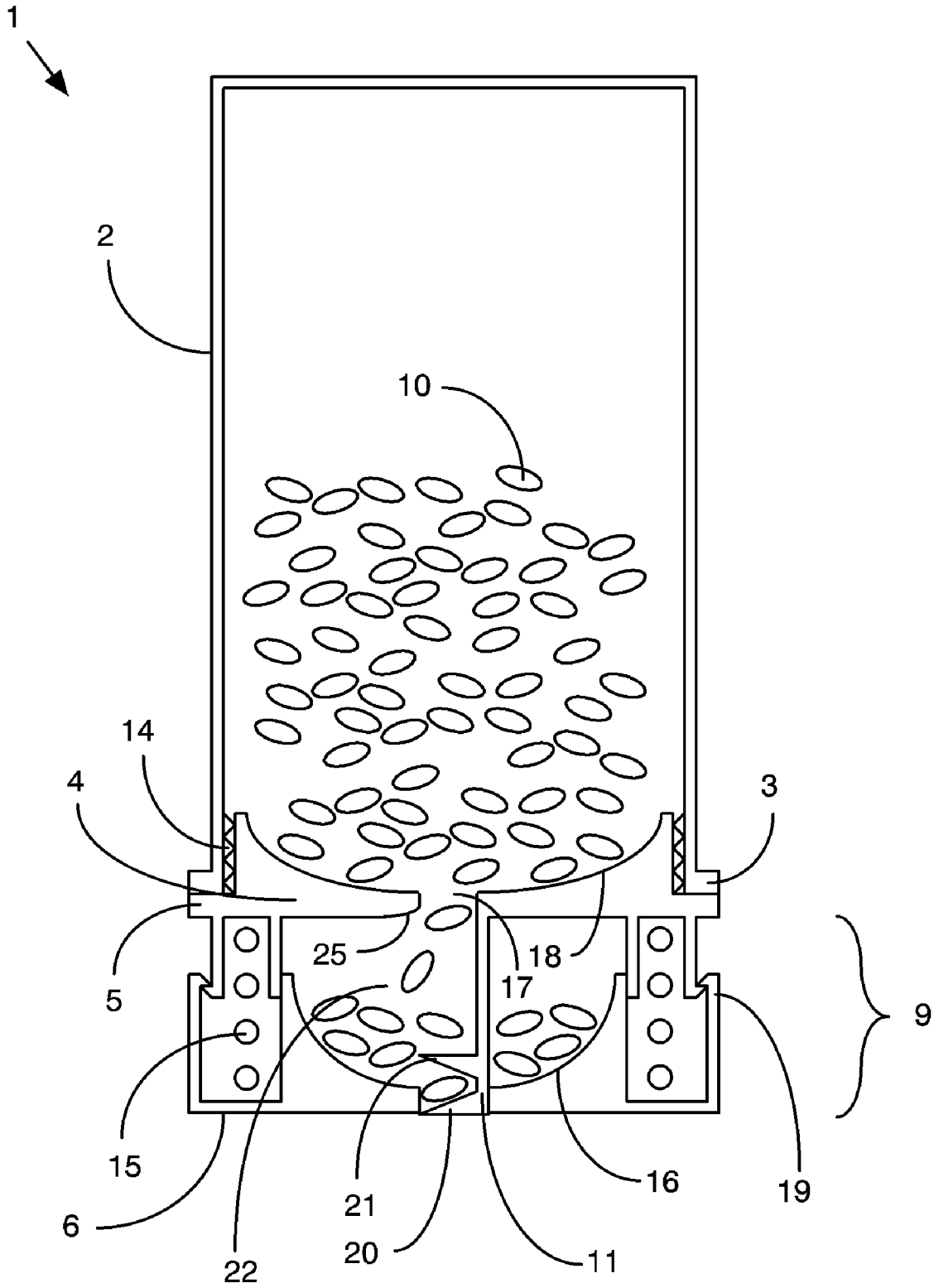
FIG. 2A illustrates a side cutaway view of a preferred embodiment of a medicine container with the pill dispensing cap held in the closed position by a helical spring.

FIG. 2A illustrates a side cutaway view of a preferred embodiment of a medicine container 1 with the pill dispensing cap 9 held in the closed position by a helical spring 15. The pill dispensing cap 9 is secured to pill storage compartment 2 via engagement threads 14 on the dispensing cap 9 and the pill storage compartment 2.

To dispense a pill 10, the medicine container 1 is first inverted. When inverted, pills 10 will slide along sloped surface 18 toward aperture 17. Some of the pills 10 will drop through aperture 17 into cap chamber 22. The pills 10 in cap chamber 22 slide along sloped surface 16 toward discharge port 11. Discharge port arms 20-21 are sized to allow only a single pill 10 to fit between them. At this point, helical spring 15 is in the expanded position (e.g., at rest) and pushes upper cap 6 away from lower cap 4. In this position, discharge port 11 is in the closed position, and prevents pill 10 from being discharged.

Once the pill 10 is discharged, the medicine container 1 is restored to the upright position. To facilitate the return of the pills 10 to the pill storage compartment 2, the upper surface 25 of the lower cap 4 is sloped to direct the pills toward aperture 17.

Figure 2B:
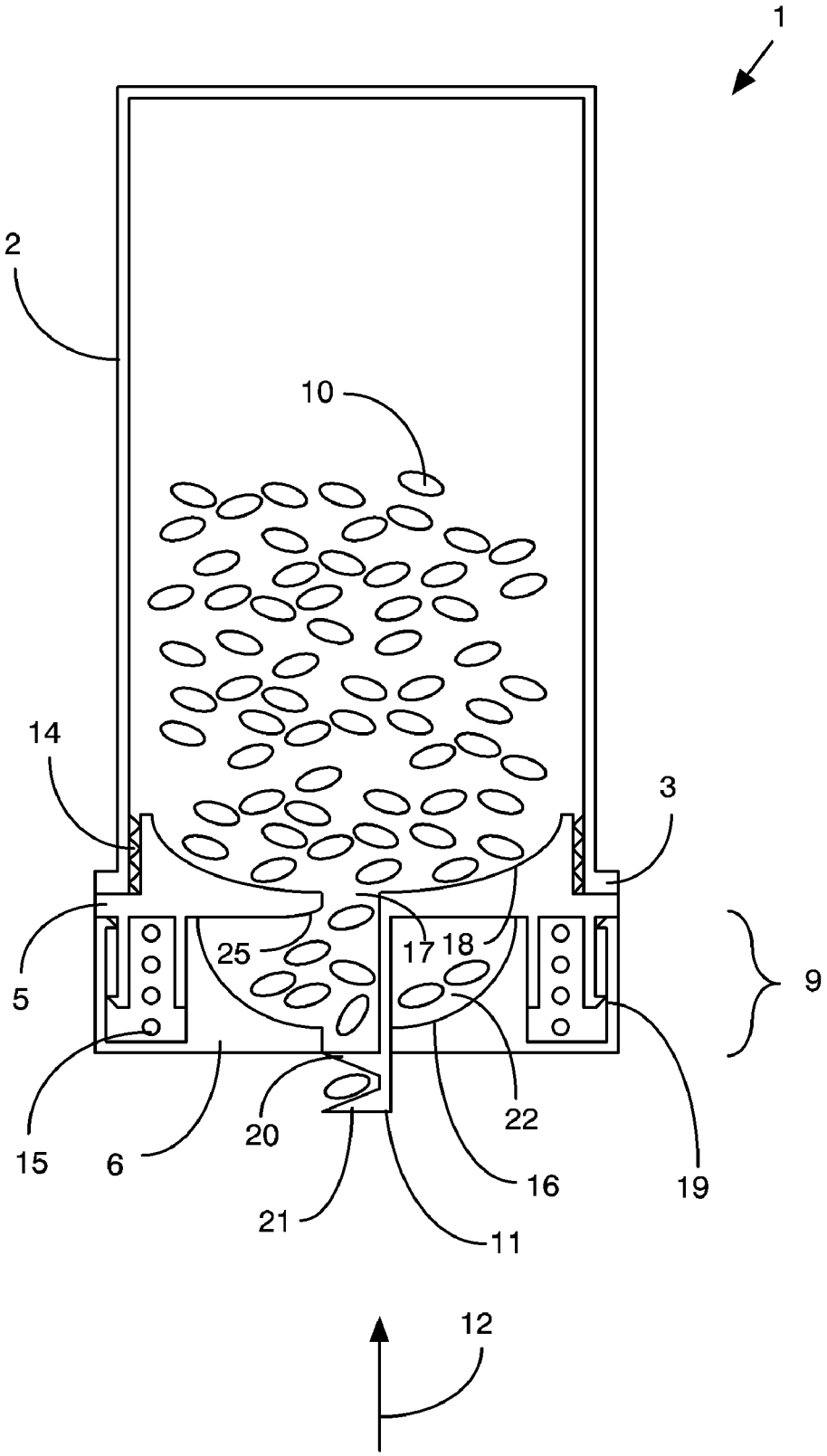
FIG. 2B illustrates a side cutaway view of a preferred embodiment of a medicine container with a pill being dispensed from the central pill channel.

FIG. 2B illustrates a side cutaway view of a preferred embodiment of a medicine container 1 with a pill 10 being dispensed from discharge port 11. In this position, upper cap 6 is compressed toward lower cap 4, as indicated by directional line 12. When helical spring 15 is compressed, upper cap 6 moves in relation to discharge port 11. When upper cap 6 moves, pill discharge port 11 extends past the surface of upper cap 6 to release pill 10.

As illustrated in FIGS. 2A-B, upper cap 6 is secured to lower cap 4 by locking clamps 19. In the preferred embodiment, upper cap 6 is fabricated from flexible material to allow it to slip over the associated locking clamp 19 on the lower cap 4 when being assembled.

Figure 3A:
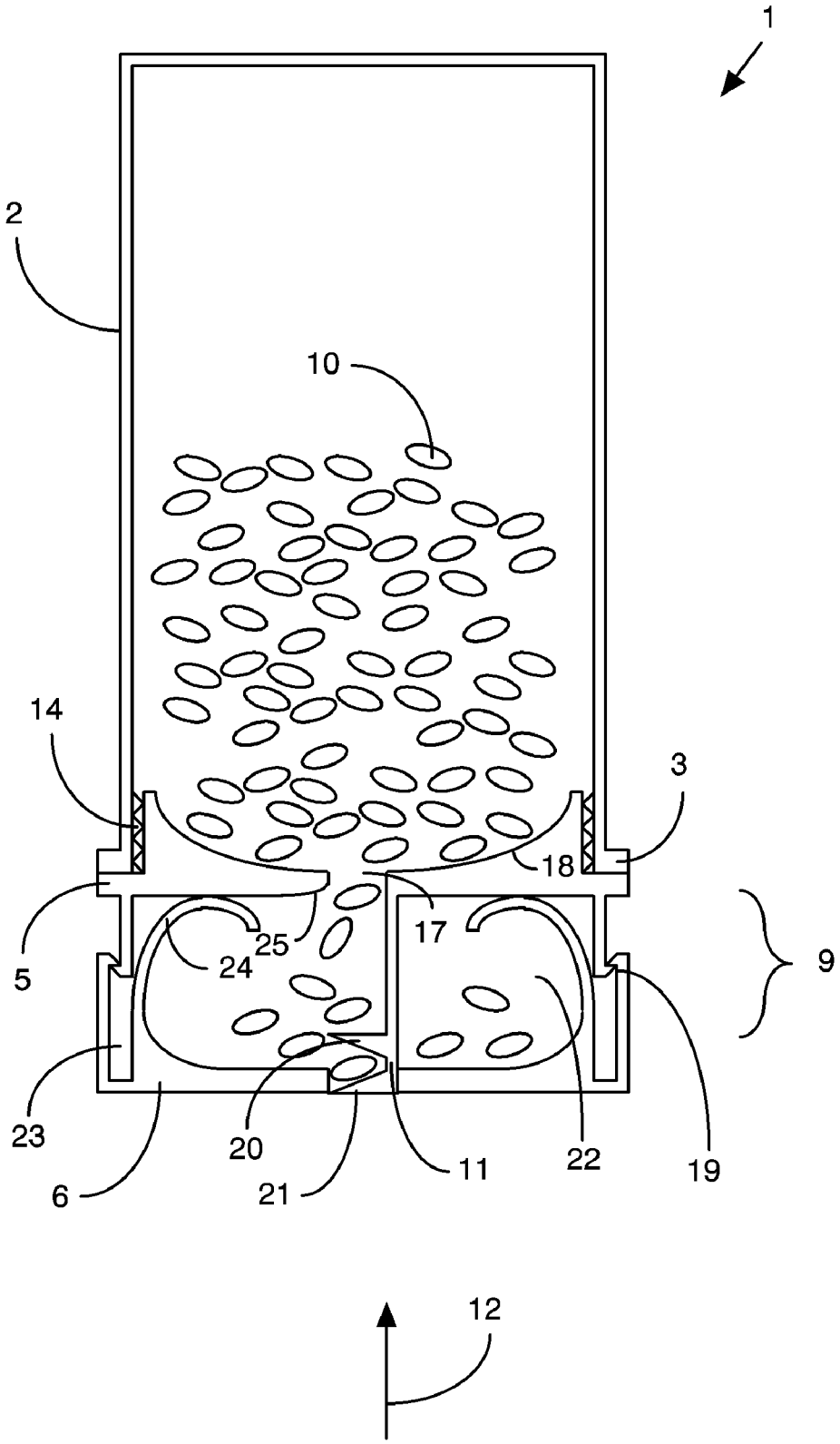
FIG. 3A illustrates a side cutaway view of a preferred embodiment of a medicine container with the pill dispensing cap held in the closed position by a leaf spring.

FIG. 3A illustrates a side cutaway view of an alternative preferred embodiment of a medicine container 1 with the pill dispensing cap 6 held in the closed position by a leaf spring 24. In this embodiment, helical spring 15 is eliminated and replaced with integral leaf spring 24. This reduces the number of parts required and simplifies the assembly process. In the closed position, leaf spring 24 pushes upper cap 6 away from lower cap 4 and closes pill discharge port 11.

During the assembly process, lower cap 4 is inserted into slot 23 of upper cap 6 until locking clamps 19 engage. Once engaged, leaf spring 24 moves the upper cap 6 to the closed position, In the closed position, a pill 10 cannot be released from pill discharge port 11.

Figure 3B:
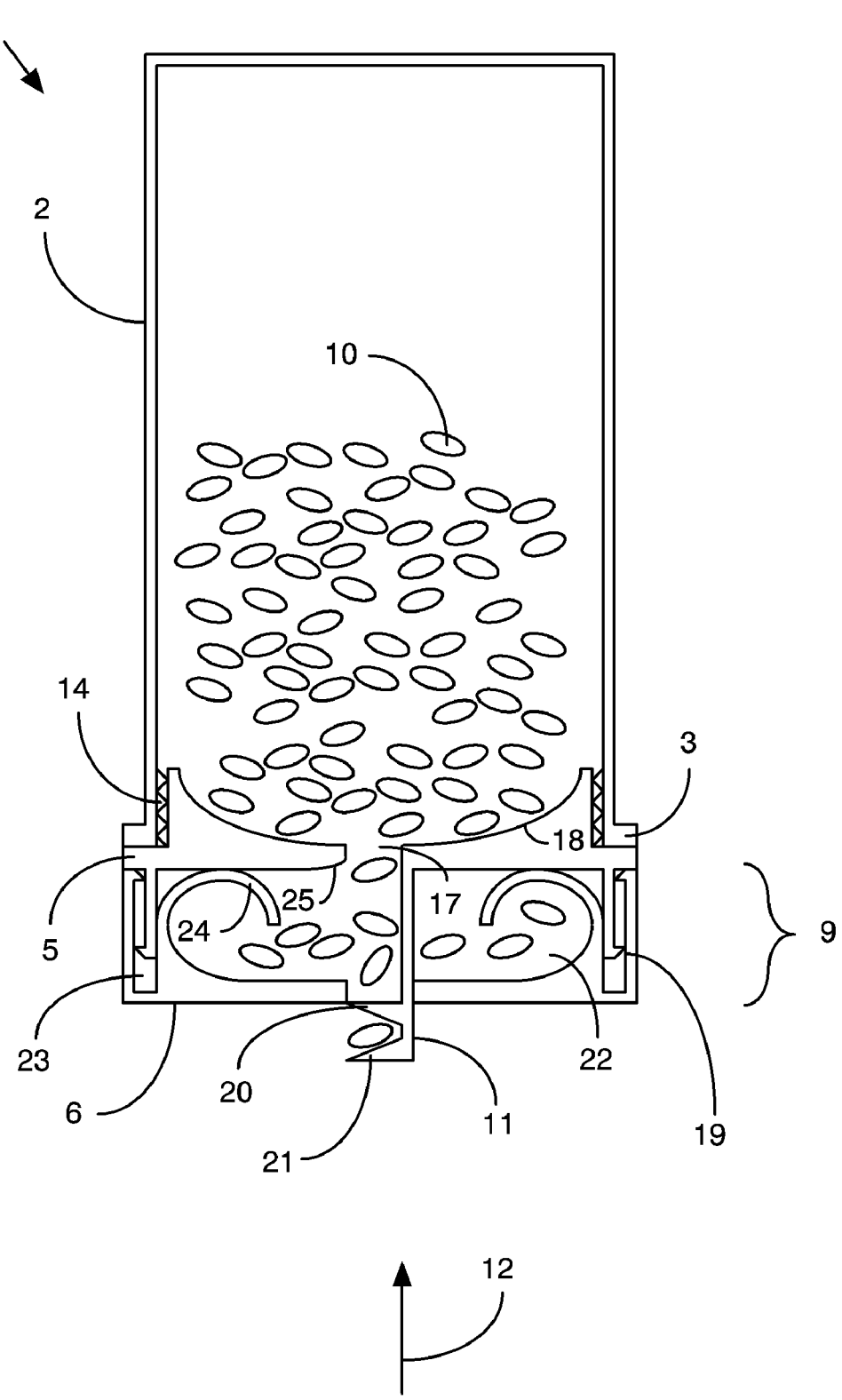
FIG. 3B illustrates a side cutaway view of a preferred embodiment of a medicine container with a pill being dispensed from the central pill channel.

FIG. 3B illustrates a side cutaway view of a preferred embodiment of a medicine container 1 with a pill 10 being dispensed from the pill discharge port 11. As was the case with the previous embodiment, a pill 10 is dispensed by compressing upper cap 6 toward lower cap 4. This exposes pill discharge port 11 which releases a pill 10.

Figure 3C:
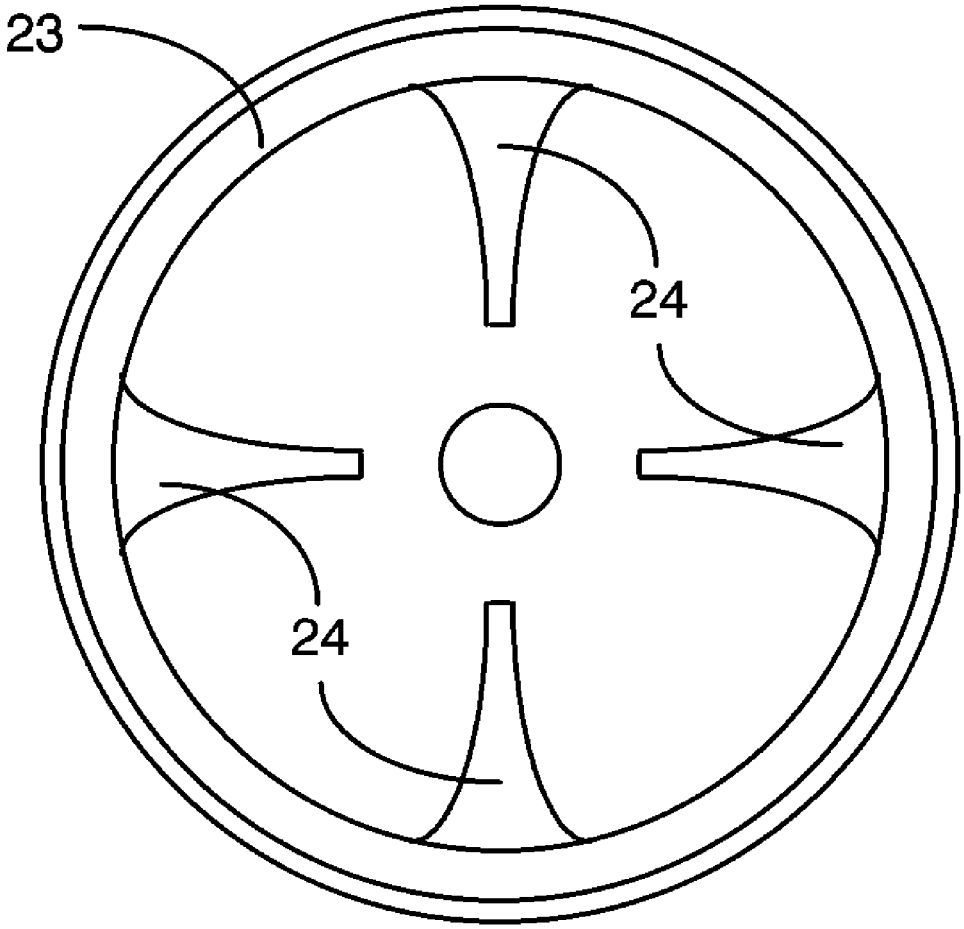
FIG. 3C illustrates a bottom plan view of a preferred embodiment of the upper cap which shows a leaf spring configuration.

FIG. 3C illustrates a bottom plan view of a preferred embodiment of the upper cap 6 which shows a preferred embodiment of the leaf spring configuration. In this embodiment, four leaf springs 24 are arranged such that they provide a uniform distribution of pressure when the upper cap 6 and the lower cap 4 are assembled. Of course, the number of leaf springs 24 and their shape can vary.

For ease of illustration, the key and slot locking mechanism have been intentioned omitted from FIGS. 2A-B and 3A-B.

Figure 4A:
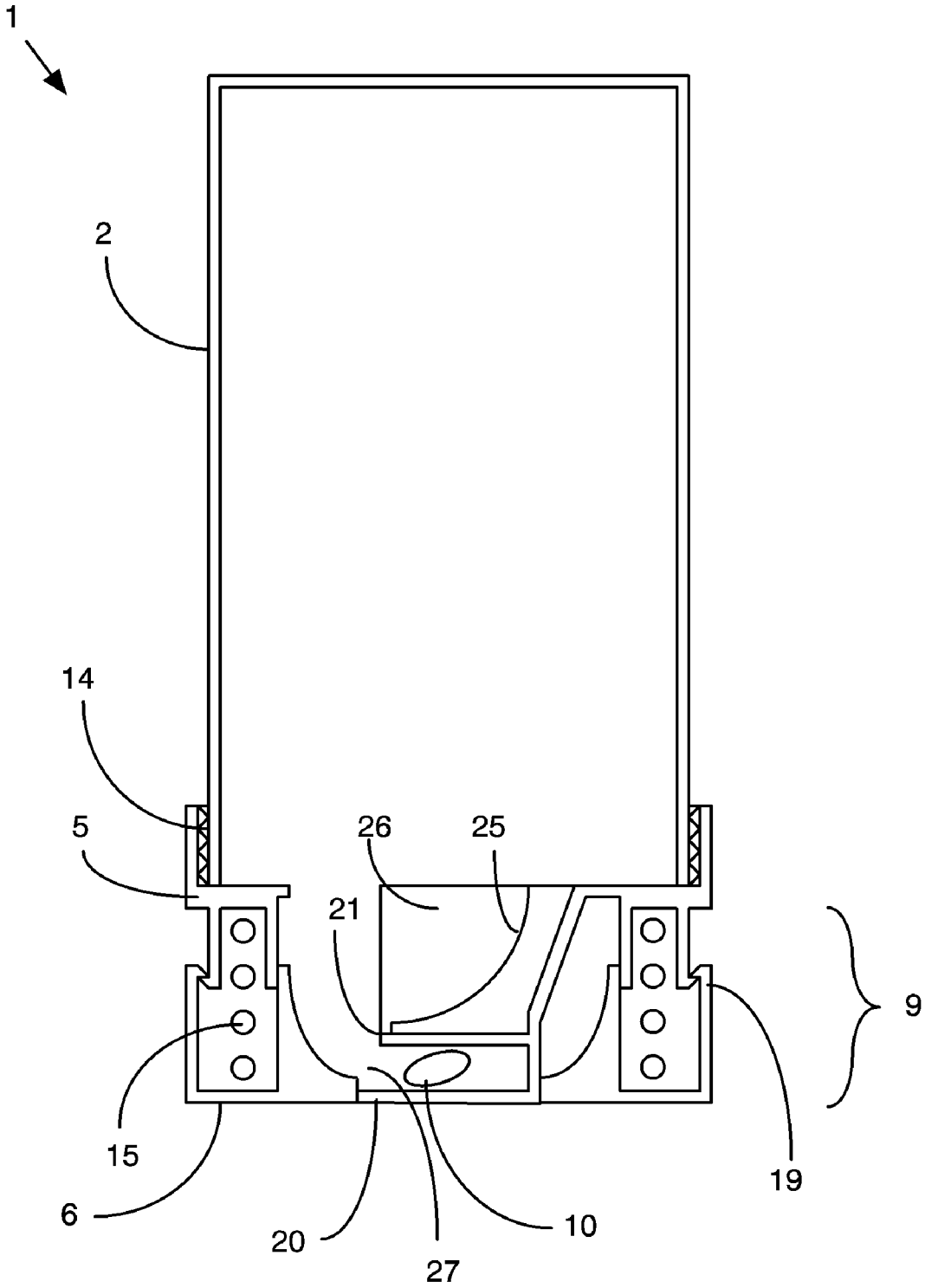
FIG. 4A illustrates a side cutaway view of an alternative preferred embodiment of a medicine container cap with the pill dispensing cap held in the closed position by a spring.

FIG. 4A is a side cutaway view of a preferred embodiment of pill dispensing cap 9. In this embodiment, a pill 10 slides down ramp 25 when the container 1 is in the inverted position. The pill 10 is further guided by sidewalls 26. When the pill 10 reaches aperture 27, it falls into the compartment between discharge port arms 20-21 which is size to accommodate a single pill.to This figure also illustrates the pill dispensing cap 9 threaded onto the outside of the pill storage compartment 2.

Pill dispensing cap 9 is held in the closed position by helical spring 15. For ease of discussion, a helical spring is used in this embodiment. However, those skilled in the art will recognize that any spring mechanism can be used, such as leaf springs, etc., for any of the embodiments.

Figure 4B:
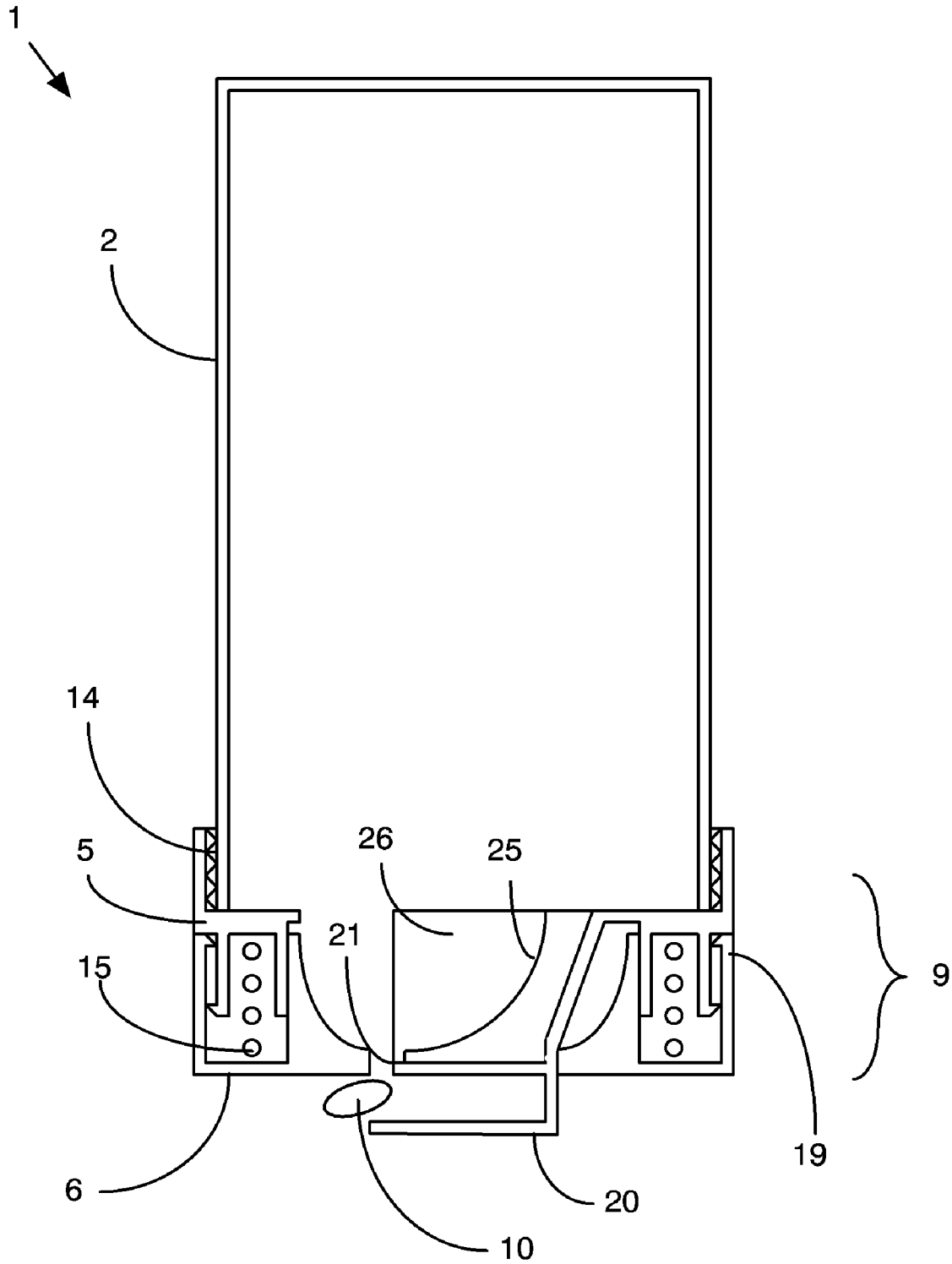
FIG. 4B illustrates a side cutaway view of a preferred embodiment of a medicine container with the cap in the open position will and a pill being dispensed.

In FIG. 4B, pill dispensing cap 9 is shown in the open position. In this position the springs 15 are compressed to allow the discharge for arms 20-21 to extend from the top of the pill dispensing cap 9. This allows the pill 10 to be discharged.

Figure 4C:
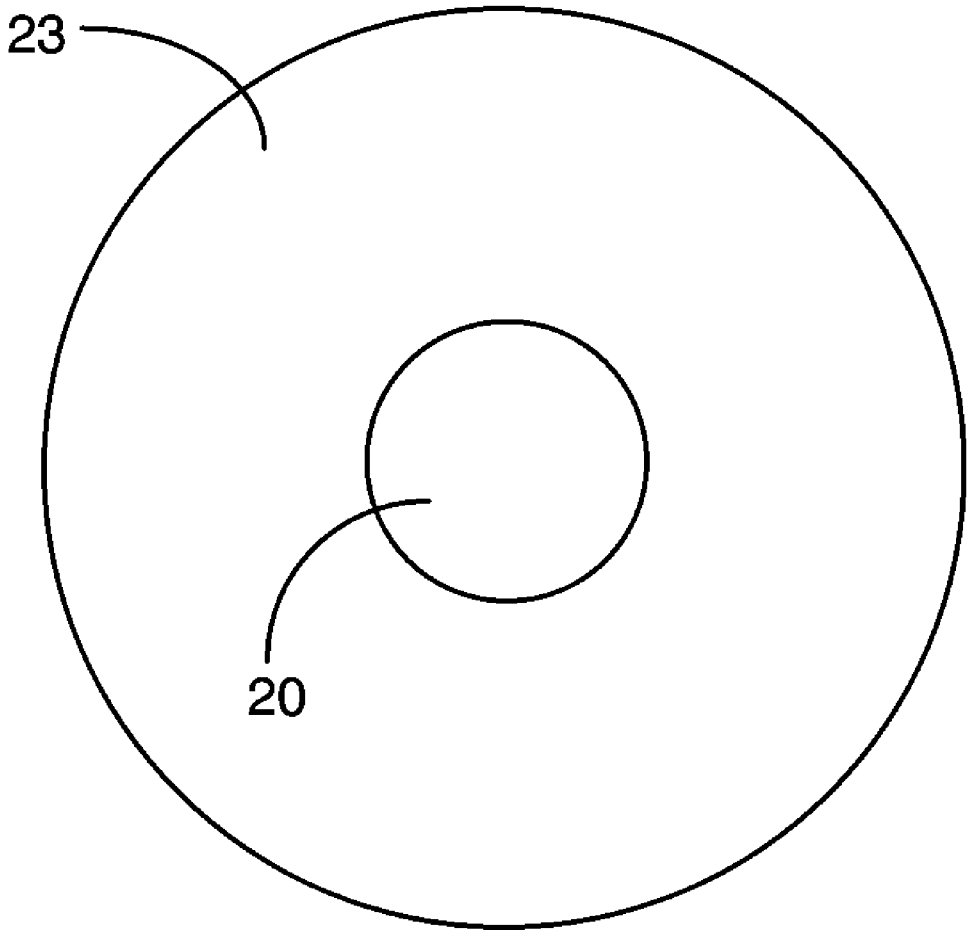
FIG. 4C illustrates a top view of the cap.

FIG. 4C illustrates a top view of the pill dispensing cap 9 in the closed position.

For ease of discussion, the device has been discussed in terms of dispensing medications and nutritional products. However, the device can just as easily be used for dispensing other products such as candies, breath mints, etc. Those skilled in the art will recognize that any small item capable of being dispensed via the dispensing cap 9, disclosed herein, can be used in conjunction with the invention.

While the invention has been described with respect to preferred embodiments thereof, it will be understood by those skilled in the art that various changes in detail may be made therein without departing from the spirit, scope, and teaching of the invention. For example, the material used to fabricate the pill dispensing cap can vary, the type of spring mechanism can vary, the size and shape of the can vary, etc. Accordingly, the invention herein disclosed is to be limited only as specified in the following claims.

We claim:

1. A pill dispensing container, further comprising:

a pill storage compartment;

a cap assembly, further comprising:

a lower cap, secured to the storage compartment;

an upper cap is secured to the lower cap such that the upper cap is movable from a closed position to a pill dispensing position; and a central pill channel having a proximal end secured to the lower cap, and extending from the lower cap to the upper cap, the central pill channel further having a distal end which is substantially flush with the upper cap in the closed position, and which extends past the surface of the upper cap when the upper cap is in the dispensing position;

a discharge port on the distal end of the central pill channel having sufficient space to accept pills when the pill dispensing container is in the closed position and held upside down, the discharge port extending past the surface of the of the central pill channel in the dispensing position such that a pills in the discharge port are released;

the upper cap is rotatably and slidably attached to the lower cap;

the lower cap is secured to the pill storage compartment;

the discharge port is sized to accept a single pill;

the upper cap moves from the closed position to the dispensing position when the upper cap is pressed toward the lower cap;

a key slot in the lower cap; and a key in the upper cap which is sized to slidably fit in the key slot, the key sliding along the key slot when the upper cap is moved between the closed and dispensing positions.

2. A container, as in claim 1, further comprising:

an alignment indicia indicating the location of the key; and the upper cap further rotatably attached to the lower cap such that the key can be rotated to align with the key slot to allow the upper cap to move to the dispensing position, and be rotated such that the key is not aligned with the key slot whereby the upper cap is prevented from moving to the dispensing position;

whereby the container can be locked to prevent access by children.

3. A container, as in claim 2, wherein:

the pills are fed into the cap assembly via gravity when held upside down.

4. A container, as in claim 3, further comprising:

a spring is interposed between the upper cap and the lower cap and provides tension to keep the cap assembly in the closed position until the upper cap is pressed toward the lower cap.

5. A container, as in claim 4, wherein:

the spring is a helical spring.

6. A container, as in claim 4, wherein:

the spring is a leaf spring.

* * * * *